US007219606B2

(12) United States Patent
Mindrup

(10) Patent No.: US 7,219,606 B2
(45) Date of Patent: May 22, 2007

(54) METHOD AND APPARATUS FOR MEASURING, SETTING AND CONTROLLING LONGITUDINAL AND LATERAL REGISTER AS WELL AS PARALLELNESS OF THE PRINTING REGISTER IN A MULTICOLOR PRINTING MACHINE

(75) Inventor: Erich Mindrup, Lengerich (DE)

(73) Assignee: Eltromat GmbH, Leopoldshohe (DE)

( * ) Notice: Subject to any disclaimer, the term of this patent is extended or adjusted under 35 U.S.C. 154(b) by 0 days.

(21) Appl. No.: 10/742,715

(22) Filed: Dec. 19, 2003

(65) Prior Publication Data

US 2004/0190966 A1 Sep. 30, 2004

(30) Foreign Application Priority Data

Dec. 24, 2002 (DE) ..... 102 61 059

(51) Int. Cl.
*B41F 33/00* (2006.01)

(52) U.S. Cl. ..... 101/484; 101/248

(58) Field of Classification Search ..... 101/486, 101/485, 484, 483, 248; 399/395, 384, 37
See application file for complete search history.

(56) References Cited

U.S. PATENT DOCUMENTS 3,701,464 A * 10/1972 Crum ..... 226/3
4,485,949 A * 12/1984 Gebhart et al. ..... 226/2
4,546,700 A * 10/1985 Kishner et al. ..... 101/211
4,569,584 A * 2/1986 St. John et al. ..... 399/301
4,731,542 A * 3/1988 Doggett ..... 250/548
5,115,141 A * 5/1992 Gold ..... 250/548
5,181,257 A * 1/1993 Steiner et al. ..... 382/162
5,412,577 A * 5/1995 Sainio et al. ..... 700/124
5,515,139 A * 5/1996 Hou et al. ..... 399/38
5,572,433 A * 11/1996 Falconer et al. ..... 700/127
5,795,087 A * 8/1998 Brower et al. ..... 400/636
6,170,727 B1 * 1/2001 Hevenor et al. ..... 226/21
6,199,480 B1 * 3/2001 Leonhardt et al. ..... 101/248
6,307,972 B1 * 10/2001 Riley et al. ..... 358/3.06
6,536,892 B1 * 3/2003 Chang et al. ..... 347/101
6,796,240 B2 * 9/2004 Sainio et al. ..... 101/485
2002/0113977 A1 * 8/2002 Silvestre ..... 356/620
2003/0205896 A1 * 11/2003 Geiger et al. ..... 283/92
2003/0222230 A1 * 12/2003 Brauner et al. ..... 250/559.29

* cited by examiner

*Primary Examiner*—Anthony Nguyen

(57) ABSTRACT

The present invention relates to a method and an apparatus for measuring, setting and controlling longitudinal and lateral register as well as parallelness of the printing register in a multicolor printing machine. To reduce waste, the longitudinal and circumferential register is sensed on a print web (D) at one side and parallelness of the print images among one another is determined at the opposite other side. To this end an independent second measuring device is preferably used. The data obtained are used for automatically controlling the printing register in lateral and circumferential direction as well as print parallelness.

17 Claims, 2 Drawing Sheets

METHOD AND APPARATUS FOR MEASURING, SETTING AND CONTROLLING LONGITUDINAL AND LATERAL REGISTER AS WELL AS PARALLELNESS OF THE PRINTING REGISTER IN A MULTICOLOR PRINTING MACHINE

CROSS REFERENCE TO RELATED APPLICATION

This application claims the benefit of the filing date of German Patent Application Number 10261059.2 filed on Dec. 24, 2002, entitled "Method And Apparatus For Measuring, Setting And Controlling Longitudinal And Lateral Register As Well As Parallelness Of The Printing Register In A Multicolor Printing Machine" the disclosure of which is incorporated herein by reference.

TECHNICAL FIELD

The present invention relates to a method and an apparatus for measuring, setting and controlling longitudinal and lateral register as well as parallelness of the printing register in a multicolor printing machine.

BACKGROUND

In multicolor printing machines, an accurate overprint of the individual subimages must be ensured, each subimage being formed of one color.

Printing machines are equipped with means permitting a shifting of the individual images in such a way that they occupy the respectively desired position. An automatic control of this operation is achieved with register control means. However, the image is translationally moved in its position relative to the other subimages in circumferential and lateral direction, which creates a positioning error.

In roll type printing series machines, a further flaw is observed that is superposed on the above-mentioned positioning error. This flaw is due to the fact that a material web is not conveyed in an exactly straight way through a printing unit for different reasons. For instance, when a printing material web is thinner at one side than at the other side, the web is pulled through the printing unit at one side only. This has the effect that, although the printing operation is carried out in an accurate position for selected positions, it is not performed in edge parallelism with the preceding print.

It is therefore standard practice, for instance in an intaglio printing machine, to guide the web in front of each printing unit over a feed roller which can be changed in its axial position relative to the axis of the plate cylinder or the imaginary printing line. With a suitably inclined position of the roller axis, this has the effect that an edge-parallel print with respect to the pre-print or an edge-parallel entry into the printing unit is now achieved.

In the formerly known methods for adjusting the feed roller, each printing unit is equipped with a manually adjustable feed roller for compensating for tolerances that might be due to the material to be printed or due to the setting of the printing machine.

This roller is imperative for the reasons explained above and is positioned in front of the printing cylinder in the printing unit. The parallelness of the pre-print is adjusted by inclination of the roller.

The parallelness of the print is basically adjusted or set during production by the printing machine. The visual control is normally carried out through a web monitoring system, which is usually installed after the last printing unit.

It is determined through this visual control whether in various printing units the feed roller has to be adjusted. In practice, the feed roller must be corrected in almost every printing unit to achieve perfect parallelness.

However, an exact manual adjustment in accordance with the flaw size is very difficult to perform and is normally not immediately successful. Hence, the feed roller must be corrected several times before achieving adequate parallelness. This adjusting process is very time-consuming and is prolonged by the fact that the printing machine must travel long distances between the place of displacement and the position for monitoring the result. Hence, waste is produced during this relatively long period of time. Since today's modern printing machines have eight to ten or even more printing units as a rule, and since a correction of the feed rollers may be required within each roll or after the rolls have been changed, the non-detection of inadequate parallelness is tantamount to a significant lack of quality which leads to a considerable amount of waste, and a considerable amount of time is additionally needed for a manual correction, which produces additional waste.

What is needed, therefore, is a method and an apparatus for measuring, setting or controlling longitudinal and lateral register as well as parallelness of the printing register in a multicolor printing machine, whereby the necessary setting work can be simplified and shortened and the amount of waste can thus be minimized.

SUMMARY

The previously mentioned problems and others are solved or improved with various embodiments of the present invention. Accordingly, there is provided, in a first aspect, a method and system for measuring, setting and controlling longitudinal and lateral register as well as parallelness of the printing register in a multicolor printing machine comprising a plurality of printing units each of the units being provided with an adjustable feed roller for correcting print image parallelness. In some embodiments, the method includes: sensing first register marks at a first position of the print web for determining first data on a register deviation in circumferential and lateral direction of the printing unit or units, sensing second register marks at a second position of the print web for determining second data on the parallelness of the print images among one another; and using the first and second data obtained for automatically controlling the printing register in lateral and circumferential direction and for controlling print parallelness, respectively.

Advantageously, methods and apparatuses incorporating various aspects of the present invention minimize the waste produced by inadequate parallelness. Moreover, the time needed for registering and setting the printing machine may be reduced drastically.

Further details, features and advantages of the invention will become apparent from the following description of embodiments taken in conjunction with the drawings.

DETAILED DESCRIPTION

Figure 1:
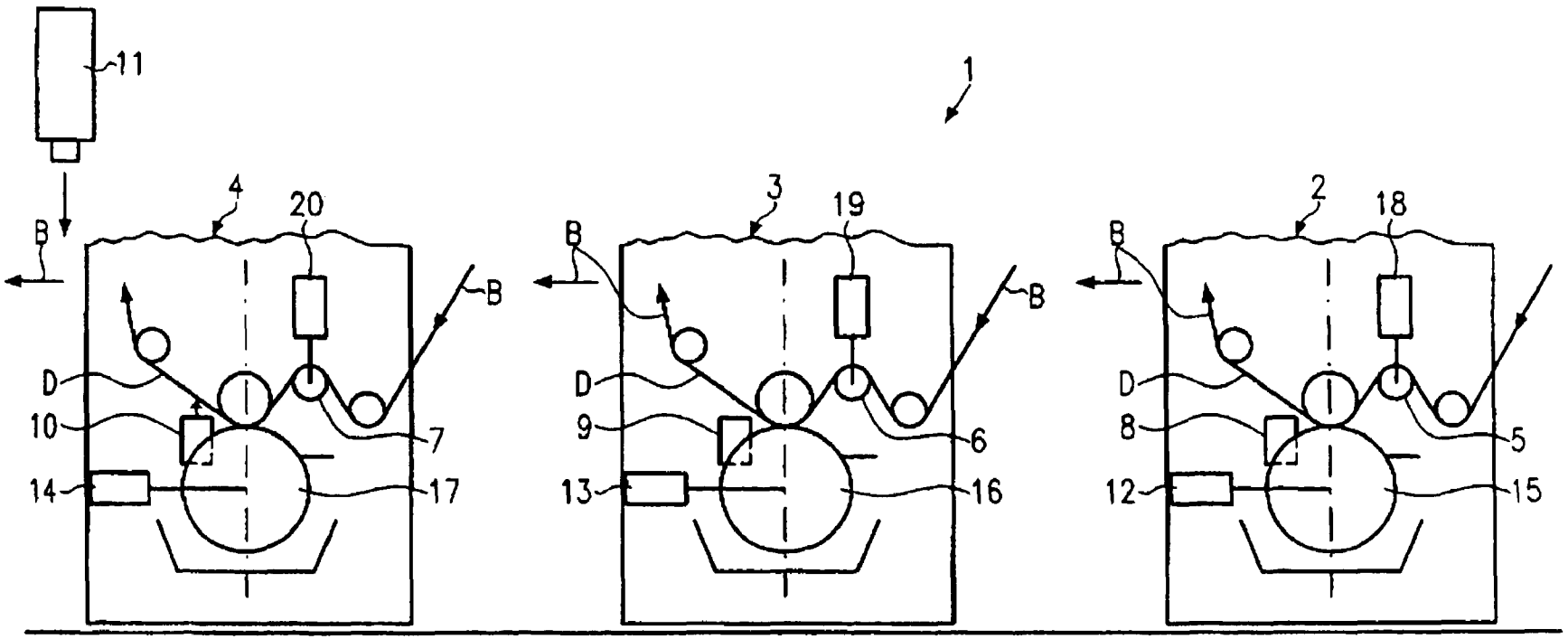
FIG. 1 is a schematically simplified illustration of a multicolor printing machine provided with an apparatus according to the invention.

The present invention provides a unique method and system for performing method and apparatus for measuring, setting and controlling longitudinal and lateral register as well as parallelness of the printing register in a multicolor printing machine. It is understood, however, that the following disclosure provides many different embodiments, or examples, for implementing different features of the invention. Specific examples of components, signals, messages, protocols, and arrangements are described below to simplify the present disclosure. These are, of course, merely examples and are not intended to limit the invention from that described in the claims. Well known elements are presented without detailed description in order not to obscure the present invention in unnecessary detail. For the most part, details unnecessary to obtain a complete understanding of the present invention have been omitted inasmuch as such details are within the skills of persons of ordinary skill in the relevant art. Details regarding control circuitry or mechanisms used to control the rotation of the various elements described herein are omitted, as such control circuits are within the skills of persons of ordinary skill in the relevant art.

In some embodiments, there is a system for measuring, setting and controlling longitudinal and lateral register as well as parallelness of a printing register in a multicolor printing machine comprising a plurality of printing units. Each printing unit comprising an adjustable feed roller for correcting print image parallelness, a first measuring device for sensing a first set of register marks at a first position of a print web for determining a first set of data on a register deviation in circumferential and lateral direction of the printing unit; and a second measuring device for sensing a second set of register marks at a second position of the print web for determining second data on the parallelness of the print images among one another. There may also be a first setting means for controlling the print register in circumferential and lateral direction of the printing unit, and a second setting means for controlling print image parallelness.

Print marks are co-printed during the printing process in each printing unit for measuring longitudinal and lateral register as well as parallelness. According to some aspects of the present invention, the marks for longitudinal and lateral register are arranged at a first position; for the detection of parallelness, they are arranged at a second position on the print sheet. The marks for longitudinal and lateral register are arranged at one side, and those for detecting parallelness at the opposite side of the print web.

For measuring the longitudinal and lateral register, standard register marks (triangles, rectangles, points) may be used in some embodiments. Point marks are provided for measuring parallelness.

First of all, the longitudinal and lateral register may be brought into a desired position, for instance, by a register controller which measures the register marks assigned to it and initiates a corresponding adjustment of circumferential or longitudinal and lateral register. A measuring operation is then carried out through the register mark field for adjusting parallelness by a second measuring device, preferably a camera that is otherwise used for monitoring the web. To this end the second measuring device takes a picture of the marks and evaluates the same in a way that is commonly known in the art of register controllers. The second measuring device is preferably installed after the last printing unit because it is at that place that it can best fulfill its second function, i.e. monitoring of the print image.

According to some embodiments of the invention, all of the marks of the point mark field are measured with the second measuring device at the same time and with respect to a previously defined principal color, and directly thereafter the printed subimages in each printing unit are set into a calculated desired position automatically and at the same time by adjusting the above-mentioned feed roller, the calculated desired position being represented by a desired position of the register point mark in the mark image. Both a nominally predetermined position and a position obtained by a manual correction of an actual state and declared to be the desired position may serve as the desired position.

To be on the safe side, the success of the correction process as has just been performed may be once again checked by the second measuring device in each setting operation after a short waiting time, which depends inter alia on the material length in the printing machine and the flaw size of the mis-register to be corrected, and, if necessary, the feed rollers are adjusted again. These cycles will be repeated until the repeated measurement no longer indicates any flaw. When the second device is designed as a web monitoring camera, the device is again available after the setting operation for its function proper, i.e. monitoring of web or print.

For ensuring a constant quality, cyclic repeated measurements may also be carried out during the continued printing process, the measurements having the sequence described above.

As previously mentioned, the first position at which the first register marks are arranged may be arranged at one side of the print web, viewed from the center of the web, whereas the second position may be located at the other side, based on the center of the web.

Advantageously, it is possible with some embodiments of the method to gain register information in the form of measured values that are obtained through appropriate measuring devices that are commonly known in the art.

According to some embodiments of the invention it is also possible to use one of the two above-mentioned sides as a reference side while the other side is used as an inclination correction side and the correction for the color register is made in compliance with the measured values of the reference side, while the correction for the inclined position is made solely using the information for the other side, the corrections being preferably carried out first at the reference side and then at the inclination correction side.

In the most novel printing machines using modern technology, the above-described sequence of a measuring regime, which consists in registering the color register in a first step and in positioning the feed rollers true to angle in a second step, may take place on the basis of the nominal values on which the used mark pattern is based. It may here be assumed that these are sufficiently accurate for the positioning of the cylinders and rollers for achieving an accurate print.

In the event that this is not the case and that a subsequent fine correction is needed on the basis of the print image, the procedure may first be carried out in accordance with the nominal values before a fine correction of the printing register is then carried out without re-adjustment of the feed rollers. After the fine register has been achieved, the positions reached are adopted as desired values for both the control of the color register as longitudinal and lateral register and the control of the feed roller. Each change in the desired values in the longitudinal register requires a simultaneous formation of new desired values at the inclination correction side.

Moreover, the desired values can be corrected independently by hand at the inclination correction side.

Moreover, it is possible that the information gained at the inclination correction side on lateral register deviation is supplied to a device for controlling or regulating lateral web shrinkage or expansion.

According to some embodiments of the invention, it is also possible to use different control algorithms for calculating the correction values for the register position and the inclination roller or feed roller adjustment.

Advantageously, the information on register deviation and parallelness is gained through two independently working systems, both systems preferably exchanging at least information on the status of the setting and controlling activities carried out by them. Preferably, the roller for inclination adjustment is only able to carry out positional changes at the inclination correction side.

It is also possible to carry out the measurement of the register deviations and their correction at the reference side in a permanent way or at a fixed regular cycle with a short period whereas the measurement of the deviation at the inclination correction side has a measuring period differing therefrom. It is here possible that the correction follows the measuring periods in time.

In an additional embodiment, it is possible to carry out the measurement of the register deviation at the reference side and the inclination correction side behind each printing unit.

In an alternative embodiment, it is possible to carry out the measurement of the register deviations at the reference side behind each printing unit whereas the measurement at the inclination correction side is carried out behind the last printing unit used for printing a side.

According to some aspects of the invention, either identical or different mark configurations may be used for the measurement of the register deviations in both systems (register deviations/parallelness).

Furthermore, it is possible that the second measurement for determining printing parallelness is only carried out if triggered by an external signal. It is here possible that such an event is a change of rolls and/or change of speed in the printing machine and/or a machine stop and/or the beginning of a new printing order.

At the beginning of a new order, all of the feed rollers may be set to a zero position, and all of the desired values may be again set to the nominal values (position reset).

According to some embodiments of the invention, the second measurement is automatically repeated periodically, the repetition being then preferably carried out when the signal has been triggered.

According to some aspects of the invention, a feed roller may be supported at one side such that it is pivotable there about an axis perpendicular to the rotational axis of the roller, and the pivotal movement is achieved through a translational movement of the bearing of the roller at the other side. The adjustment is carried out on the basis of a correcting variable determined for the inclination correction, the translationally fixed rotatable bearing being preferably arranged at the reference side.

Sensing heads in the form of cameras or also reflection or transmission sensors of a design commonly known in the art may be provided as the first and second measuring devices. Of course, it is also possible that the variants for the sensing heads are used in a mixed form. Alternatively, it is possible that the measuring device for obtaining measurement values consists of at least one opto-electric sensing head at each side, and at least two register marks of the register marks printed by one respective printing unit are preferably scanned.

When at least one sensing head at the inclination correction side is designed as a camera, the camera may evaluate at least two marks printed in different printing units.

It is also possible that the camera used as a sensing head is a camera which is positioned on a cross bar transverse to the direction of the web and is transversely displaceable on the cross bar and also used for video monitoring of the web. This camera may be preferably arranged behind the printing unit of the printing machine that performs the last printing operation.

The apparatus according to the invention can convert the determined deviations into correcting variables, and the correcting variables can each be supplied to a motor-driven actuator that in each printing unit carries out the correction adjustment assigned to it.

The correcting variable may be transmitted via a digital data interface to a controller that will further process the correcting values.

Turning now to an illustrative example: in FIG. 1, there is shown in a schematically simplified manner a multicolor printing machine 1, which in this example, comprises three printing units 2, 3 and 4. The printing units 2, 3 and 4 are successively arranged in the traveling direction of the web. However, as has been explained previously, a smaller or greater number of printing units may be provided.

Each of the printing units 2, 3 and 4 comprises a print roller 15, 16 and 17, respectively, each having arranged upstream thereof, when viewed in the web travel direction B, a feed roller 5, 6 and 7, respectively, for correcting the parallelness of the print images.

In the embodiment shown in FIG. 1, each of the printing units 2, 3 and 4, respectively, has installed therein a first measuring device 8, 9 and 10, respectively, which serves to sense first register marks at a first position of the print web D for determining first data on a register deviation in the circumferential and lateral direction of the printing unit. The first measuring device 8, 9 and 10, respectively, may be designed as a sensing head in the above-explained way.

Furthermore, a first setting means 12, 13 and 14, respectively, is provided in each printing unit 2, 3 and 4, respectively, for controlling the printing register in circumferential and lateral direction, and further a second setting means 18, 19 and 20, respectively, for controlling parallelness of the print images. The operation of the apparatus will be explained in more detail hereinafter with reference to FIG. 2.

The particularly illustrated embodiment of the apparatus of the invention as shown in FIG. 1 comprises a second measuring device 11, which is here designed as a camera and arranged after the last printing unit 4. The measuring device serves to detect the second register marks at a second position of the print web D, the detection serving to determine second data on the parallelness of the print images among one another.

In the embodiment shown in FIG. 1, the second measuring device 11 may be designed as a camera that as such serves to monitor web and print after the last printing unit 4. To be able to transfer the camera 11 to the second position for sensing the second register marks, the camera 11 may be arranged on a cross bar (not shown) in a direction transverse to the web travel direction B. The camera 11 may be displaced along the cross bar preferably by a motor and automatically to the respective position relative to the print web D, so that it can fulfill its respective function.

Figure 2:
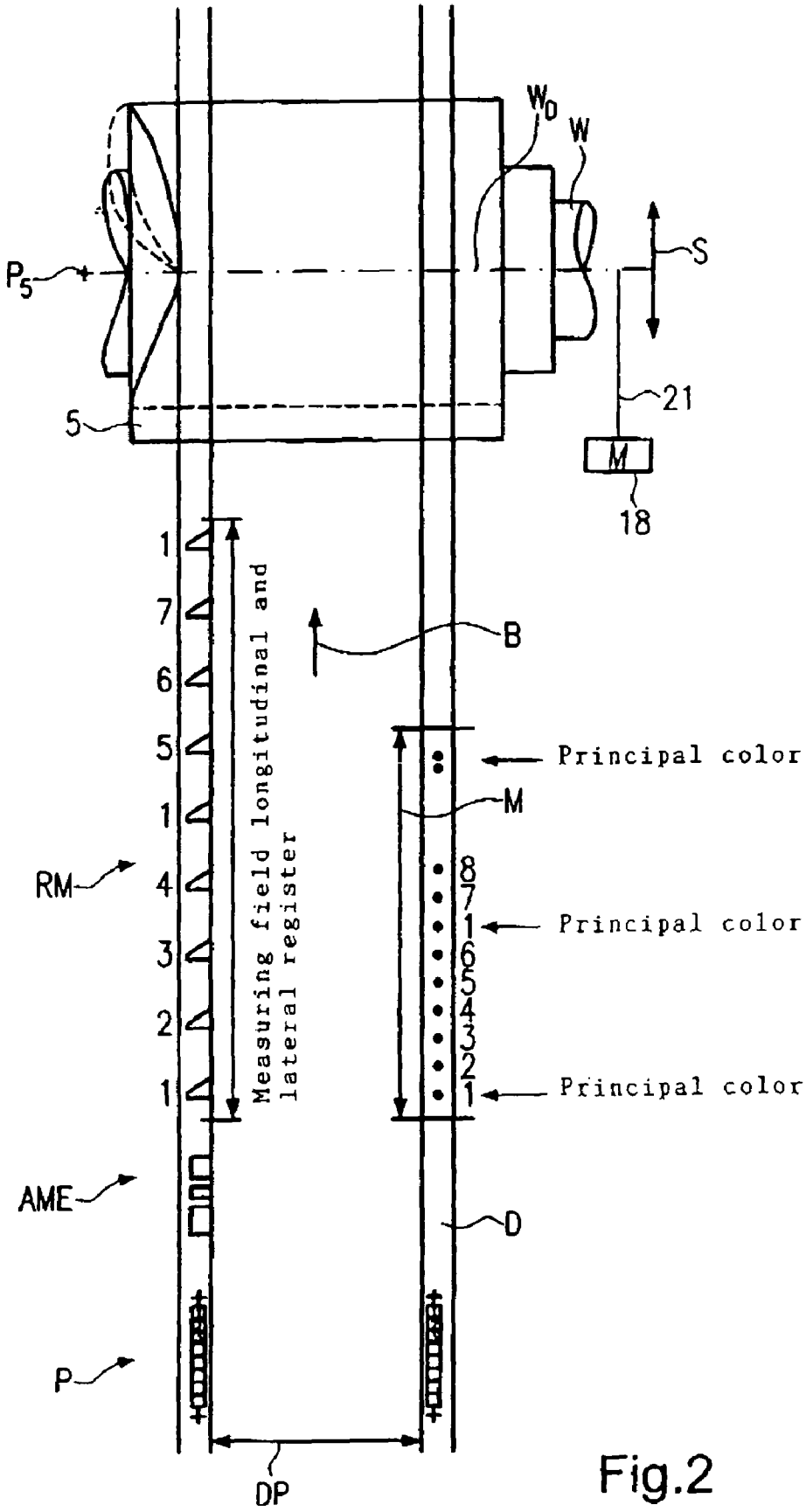
FIG. 2 is an also schematically simplified illustration showing part of the print web together with a feed roller arranged in front of each printing unit.

FIG. 2 is a schematically simplified top view on part of the print web D having a web travel direction that is again illustrated by arrow B.

A print image, which is illustrated by the inner boundary lines according to the double-headed arrow DP, may be printed onto the print web D.

At the left side of the print web D, register marks, eight in the present example, for the longitudinal and lateral register are printed onto a side strip at the left side of the print image DP. Furthermore, according to the illustration chosen in FIG. 2, an AME block mark is printed as a trigger mark below the register marks RM at one side of the print image DP.

Finally, so-called register signs or register crosses are provided below the block mark at both sides of the print image DP for visually controlling longitudinal and lateral register as well as parallelness. The register signs are not imperative for a procedure according to the invention, but may be advantageous for a visual assessment of the register.

At the opposite side of the register marks RM, a measuring field, symbolized by the double-headed arrow M, is provided for parallelness. This field consists of a multitude of point marks, point 1 representing the principal color each time. The principal color may e.g. be yellow. Points 2 to 8 are additional marks, for instance, for the colors dark-red, light-blue, brown, green, light-red, dark-blue, and black.

This example arrangement of register marks, which are co-printed at both sides of the web center of the print web D at the side of the print image DP in the particularly preferred embodiment as shown in FIG. 2, may be scanned and evaluated by the device which has been explained with reference to FIG. 1 and is used for sensing register deviation in circumferential and lateral direction (according to FIG. 1 left side) and for gathering data for determining parallelness of the print image (in FIG. 2, right side), and is supplied to the respective setting means.

In FIG. 2, one of the feed rollers shown in FIG. 1 is illustrated in a schematically simplified view at the upper end of the print web D, where feed roller 5 being chosen by way of example. The feed roller 5 has a point of rotation $P_5$, and the shaft W of the feed roller 5 can be adjusted obliquely by the associated setting means 18 according to the double-headed arrow S to correct parallelness, as has been explained at the outset. The setting means 18 may here be an appropriate servo motor which acts on the shaft W via a connection 21, which is schematically shown in FIG. 2.

The foregoing description of the embodiments of the invention has been presented for the purposes of illustration and description. It is not intended to be exhaustive or to limit the invention to the precise form disclosed. Many modifications and variations are possible in light of the above teaching. It is intended that the scope of the invention be limited not by this detailed description, but rather by the claims appended hereto.

The abstract of the disclosure is provided for the sole reason of complying with the rules requiring an abstract, which will allow a searcher to quickly ascertain the subject matter of the technical disclosure of any patent issued from this disclosure. It is submitted with the understanding that it will not be used to interpret or limit the scope or meaning of the claims.

The invention claimed is:

1. A method for measuring, setting and controlling longitudinal and lateral register as well as parallelness of a printing register in a multicolor printing machine comprising a plurality of printing units each printing unit having an adjustable feed roller for correcting print image parallelness, the method comprising:

sensing, at a first position of a print web located before a last print unit, a first plurality of register marks for determining a first set of data on a register deviation in a circumferential and a lateral direction of each printing unit;

using the first set of data for automatically controlling the printing register in the circumferential and lateral direction;

sensing, at a second position located after a last print unit, a second plurality of register point marks for determining a second set of data on the parallelness of the print images among one another; and using the first and second sets of data obtained for automatically controlling the printing register in lateral and circumferential direction and for controlling print parallelness, respectively.

2. The method of claim 1, wherein the first position for obtaining the first set of data is arranged at a first side of a web center of the print web and the second position for obtaining the second set of data is arranged at the other side of the web center of the print web.

3. The method of claim 1, wherein a first side of the first position of the print web is used as a reference side while the second position of the print web is used as an inclination correction side.

4. The method of claim 1, wherein measurements of register deviations and correction thereof are carried out at a reference side permanently or in a regular cycle with a short period while a measurement of the deviations at the inclination correction side has a measuring period differing therefrom, and the correction follows the measuring periods in time.

5. The method of claim 1 wherein measurements of register deviations at a reference side and an inclination correction side takes place behind each printing unit.

6. The method of claim 1 wherein measurements of register deviations at a reference side takes place behind each printing unit and the measurement at an inclination correction side takes place behind a last printing unit.

7. The method of claim 1 wherein identical or different register mark configurations are used for measuring register deviations regarding lateral and circumferential register and parallelness, respectively.

8. The method of claim 1 wherein the sensing of the second plurality of the register marks at the second position of the print web is only carried out if triggered by an external signal.

9. The method of claim 1 wherein the sensing of the second plurality of the register marks is automatically repeated periodically.

10. A multi-color printing machine system comprising:

an independent measuring device;

a plurality of printing units successively positioned along a longitudinal traveling direction of a printing web, wherein each printing unit of the plurality of printing units comprises:

an adjustable feed roller for correcting print image parallelness, a first measuring device for sensing register marks at a position of a print web and for determining register deviation in circumferential and lateral directions;

a first setting device for controlling the printing register in the circumferential and lateral directions wherein adjustments are made based on signals received from the first measuring device; and a second setting device for controlling the parallelness of the print images, wherein adiustments are made based on signals received from the independent measuring device;

wherein the independent measuring device is longitudinally positioned after a final printing unit of the plurality of printing units.

11. The system of claim 10 wherein the first and independent measuring devices are opto-electric sensing heads.

12. The system of claim 11 wherein the sensing heads of the second measuring device is a camera.

13. The system of claim 10 wherein the independent measuring device is a camera positioned on a cross bar transverse to the web direction of the print web.

14. The system of claim 12 wherein the camera is positioned behind the last printing unit of the plurality of printing units.

15. The system of claim 10 further comprising a feed roller pivotably supported around a rotational axis which is perpendicular to a rotational axis of the feed roller.

16. The system of claim 10 wherein the first and independent measuring devices are reflection or transmission sensors.

17. A multi-color printing machine system comprising:

a plurality of printing units successively positioned along a longitudinal traveling direction of a printing web, and an independent measuring device for determining parallelness of print images printed on the printing web by sensing a plurality of register point marks on a single side of the printing web, wherein the independent measuring device is longitudinally positioned after a final printing unit of the plurality of printing units;

wherein each printing unit of the plurality of printing units comprises:

an adjustable print roller for correcting the parallelness of print images;

a first measuring device for sensing register marks at a position of the print web for determining register deviation in circumferential, and lateral directions;

a first setting device for controlling the printing register in the circumferential and lateral directions, wherein adjustments are made using the first setting device based on signals received from the first measuring device; and a second setting device for controlling the parallelness of the print images wherein adjustments are made based on signals received from the independent measuring device.

* * * * *